US008978778B2

(12) United States Patent
Kallergis

(10) Patent No.: US 8,978,778 B2
(45) Date of Patent: Mar. 17, 2015

(54) FIRE EXTINGUISHING SYSTEM FOR AN AIRPLANE AND METHOD FOR FIREFIGHTING IN AN AIRPLANE

(75) Inventor: Konstantin Kallergis, Stuhr (DE)

(73) Assignee: Airbus Operations GmbH, Hamburg (DE)

( * ) Notice: Subject to any disclaimer, the term of this patent is extended or adjusted under 35 U.S.C. 154(b) by 888 days.

(21) Appl. No.: 13/167,924

(22) Filed: Jun. 24, 2011

(65) Prior Publication Data

US 2011/0315408 A1 Dec. 29, 2011

Related U.S. Application Data

(60) Provisional application No. 61/358,484, filed on Jun. 25, 2010.

(51) Int. Cl.
*A62C 2/00* (2006.01)
*A62C 3/08* (2006.01)
*A62C 37/44* (2006.01)

(52) U.S. Cl.
CPC .. *A62C 3/08* (2013.01); *A62C 37/44* (2013.01)
USPC ..... 169/46; 169/60

(58) Field of Classification Search
CPC ..... A62C 3/08; A62C 35/00; A62C 99/0009
USPC ..... 169/43, 45, 46, 60, 61, 18, 19; 239/67, 239/69
See application file for complete search history.

(56) References Cited

U.S. PATENT DOCUMENTS

| | | | | |
|---|---|---|---|---|
| 2,413,087 | A * | 12/1946 | Urbany | 169/61 |
| 3,783,946 | A | 1/1974 | Petrinec et al. | |
| 4,566,542 | A * | 1/1986 | Enk et al. | 169/62 |
| 7,900,709 | B2 * | 3/2011 | Kotliar | 169/45 |
| 2005/0183869 | A1 | 8/2005 | Lazzarini | |

* cited by examiner

*Primary Examiner* — Davis Hwu
(74) *Attorney, Agent, or Firm* — Hoffmann & Baron, LLP

(57) ABSTRACT

An airplane fire extinguishing system comprises an extinguishing agent storage unit with an activatable closing device, which makes possible, when active, an outflow of extinguishing agent from the extinguishing agent storage unit, and a supply line, connected with the closing device and an outlet opening, via which the extinguishing agent can be conducted from the extinguishing agent storage unit to the outlet opening, in order to eject it there for firefighting, wherein one or more sensor systems are present, by means of which a current airplane state can be determined, and a control unit, connected with the closing device and an actuatable input element, is present, via which the closing device can be activated, the control unit constructed and configured in such a way that the closing device is activated, as a function of the current airplane state, which exists at the time of an actuation of the input element.

20 Claims, 1 Drawing Sheet

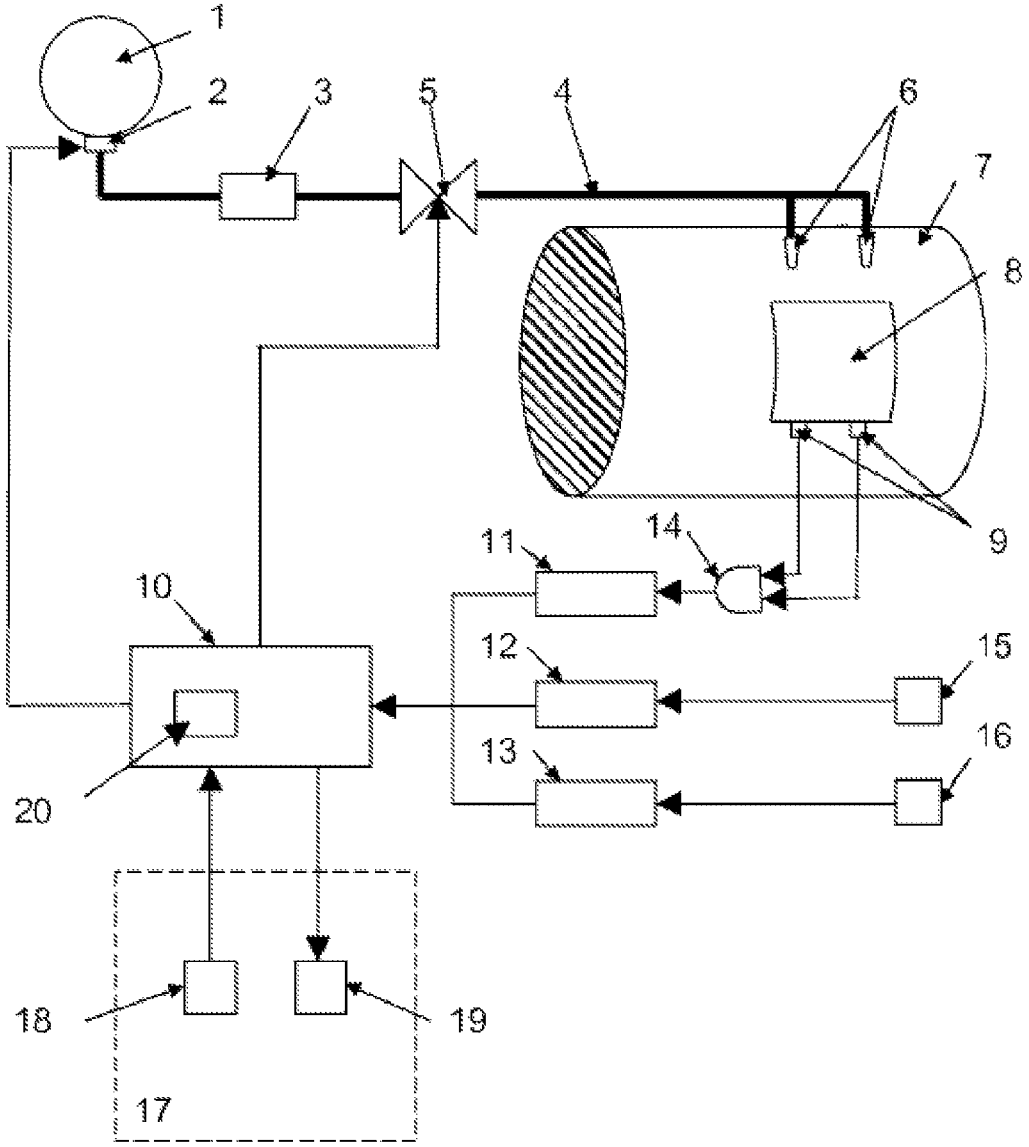
1
2
3
5
4
6
7
8
9
14
11
10
12
15
13
16
20
18
19
17

FIRE EXTINGUISHING SYSTEM FOR AN AIRPLANE AND METHOD FOR FIREFIGHTING IN AN AIRPLANE

CROSS REFERENCE TO RELATED APPLICATION

This application claims priority to U.S. Provisional Application No. 61/358,484 filed on Jun. 25, 2010, which is incorporated herein by reference in its entirety.

BACKGROUND

1. Field

The invention concerns a fire extinguishing system for an airplane, in particular, for firefighting in cargo holds of the airplane, comprising at least one extinguishing agent storage unit with an activatable closing device, which makes possible, when activated, the flowing out of the extinguishing agent from the extinguishing agent storage unit, and a supply line, connected with the closing device and at least one outlet opening, by means of which the extinguishing agent can be conducted from the extinguishing agent storage unit to the outlet opening, so as to eject it there, in a targeted manner, into a relevant space for firefighting. In addition, the invention concerns a method for fighting fires in an airplane.

2. Brief Discussion of Related Art

Airplanes beyond a certain weight class must, as is known, have a fire protection system. This fire protection system consists of a fire alarm system and a fire extinguishing system. The fire alarm system typically includes a fire sensor or over-temperature sensor, which must be installed in every particularly fire-prone area of the airplane, monitoring devices and heat devices in the cockpit. Particularly fire-prone areas are: the engines and auxiliary power systems, such as the auxiliary turbines (APU, Auxiliary Power Unit). Moreover, fire and over-temperature sensors can be installed in the following areas: landing gear shafts, cargo holds and areas which lead to hot engine air ("bleed air") for the deicing or heating. Each response to a fire alarm system triggers an optical and usually also an acoustic warning in the cockpit. In particular, cargo holds of the classes B, C, and E must be included in the fire alarm system. Fire is predominantly not detected there by a temperature measurement, but rather by smoke detectors and/or gas detectors because of the large volume of the cargo holds.

In all areas in the airplane in which a hazard for the airplane and its crew can appear due to a fire, a fire extinguishing means must be available. A fire can be fought using a manual fire extinguisher in the cockpit and the passenger cabin. Permanently installed fire extinguishing systems must be available at inaccessible places, especially in the cargo holds, on the engines, and the auxiliary power systems. For these permanently installed fire extinguishing systems, the cockpit crew must make the decision to use an extinguisher when the fire alarm system signals a fire alarm for one of these areas.

The permanently installed fire extinguishing systems comprise at least one extinguishing agent storage unit with a closing device located on it. The extinguishing agent storage unit is connected with one or more supply lines via the closing device; through the lines, the extinguishing agent gets from the extinguishing agent storage unit to the exit openings located in fire hazard areas, so as to be ejected, in a targeted manner, from there for fighting fire in predetermined fire hazard areas. The closing device is activated by the cockpit crew by means of a manually actuatable input element, namely a toggle or key, which is protected from an unintended actuation. The closing device can, for example, be formed as diaphragms, which can be pyrotechnically activated once by means of an electrical ignition impulse—that is, once to open and cannot be closed again. By the actuation of the input element, the ignition impulse is initiated, which leads to the bursting of the diaphragms.

A number of fire extinguishing systems are known for airplanes. Thus, a fire extinguishing device with two fire extinguishing agent containers for extinguishing agents under excess pressure to produce a first and second fire extinguishing deployment for cargo holds of airplanes can be found in DE 36 15 415 C2. DE 10 051 662 A1 reveals a device in which the oxygen required for the maintenance of the fire is removed by the introduction of nitrogen into the closed space, and thus the fire is extinguished. EP 0 234 056 A1 describes a fire extinguishing system to extinguish a fire which has erupted within the cabin or a cargo hold of a passenger airplane. This fire extinguishing system contains a reservoir to store pressure-liquefied halon, which is connected, via a pipeline system, to extinguishing nozzles, located within the cabin or the cargo hold. The halon is supplied to the cabin or the cargo hold as an extinguishing agent, building up the extinguishing-effective concentration in a short time, via outlet openings (extinguishing nozzles).

Nowadays, there is a decreasing tendency to use halons as extinguishing agents. Halons are halogenated hydrocarbons, the basic molecules which consist of carbon and hydrogen and in which a variable number of hydrogen atoms is replaced by halogen atoms. The presence of fluorine brings about a great stability of the molecules and thus contributes decisively to these compounds being comparatively nontoxic. The extinguishing effect of the halons is based on the fact that they decompose in flame heat and cleavage products, reacting with the carriers of the combustion reaction. In this way, the combustion reaction is stopped. This process is designated as the anticatalytic effect.

Nowadays, the halons trifluorobromomethane ($CF_3Br$, BTM, halon 1301) and bromochlorodifluoromethane ($CBrClF_2$, BCF, halon 1211) are still most frequently used in airplanes. They have an excellent extinguishing effect and are comparatively nontoxic. The decomposition products formed during the extinguishing deployment, however, are toxic, but in contrast to the $CO_2$ gas and the carbon monoxide (CO) formed during the fire, have a warning effect due to the irritation of the mucosa. Halons, however, as is known, are also climate-affecting substances, which, on the one hand, degrade the ozone layer of the stratosphere, and, on the other hand, promote the greenhouse effect. Therefore, they are forbidden by the Montreal Protocol (1989). For deployment as an extinguishing agent in airplane extinguishing systems, however, limited special exemptions exist.

Already, effective alternative extinguishing agents exist that contribute less, or not at all, toward increasing the greenhouse effect, and have smaller effect on the ozone, to none at all, in the stratosphere, for example, trifluoroiodomethane ($CF_3I$). In the meantime, these alternative extinguishing agents are available at lower costs in comparison to the halons 1301 and 1211. The alternative extinguishing agents are, however, not suitable for spaces occupied by persons because they are harmful/toxic to humans. Since cargo holds are counted among the person-occupied spaces of an airplane, because at least on the ground, persons may stay in the cargo holds during the loading and unloading of the cargo holds, these alternative extinguishing agents are not used, at present, in extinguishing agent systems for cargo holds. Therefore, in addition to the basic need for an extinguishing agent that is not harmful to humans and the environment, as a replacement for the hitherto still used halons 1211 and 1301, there is a need, because of economic considerations, to use, as extinguishing agents in fire extinguishing systems for cargo holds, the more favorable extinguishing agents that are already available nowadays, but that have not been approved for use in cargo holds. As a result of the large volume of the cargo holds, a correspondingly large quantity of extinguishing agent is needed in the extinguishing agent storage units of the fire extinguishing systems, which with a use of the alternative extinguishing agents, generates lower costs in comparison to the halons 1211 and 1301.

Another disadvantageous aspect of the known fire extinguishing systems comes from the fact that the fire alarm system and the fire extinguishing system of an airplane are always completely deployable when the airplane is provided with power, that is, in the state "Electrical Power ON". This electrical state is also frequently present when the airplane is on the ground and the engines are turned off, for example, if work is being done on the airplane for maintenance purposes, or for loading and unloading cargo, for catering, or for cleaning the cabin in the turned-off or parked position. In individual cases, it happens that the manual input element for the triggering of a fire extinguishing system by maintenance personnel or the crew is actuated inadvertently and/or unintentionally without a fire having been reported. Furthermore, within the scope of system tests, false alarms of the fire alarm system can be generated, that is, there is a fire alarm in the cockpit without there actually being a fire. The disadvantage is that in these cases, the closing device on the extinguishing agent storage unit is activated as a result of a manual actuation of the input element, and as a result, the extinguishing agent is ejected via the outlet openings of the individual fire extinguishing system without there actually being a fire to be extinguished.

In addition, with a fire actually present in the cargo hold of a plane parked on the ground, the extinguishing agent concentration required for an effective fighting of the fire is not attained in the case of an opened cargo hold door of the cargo hold, after an activation of the fire extinguishing system, so that such a fire cannot be extinguished with a permanently installed fire extinguishing system, or at least cannot be done so effectively, but rather, it becomes necessary to resort to mobile ground extinguishing systems (fire department, manual fire extinguishers, etc.). In all of these cases, extinguishing agents have been introduced, up to now, with ground operation of the airplane, intentionally or unintentionally, without this extinguishing agent being able to act effectively, either because there is no fire at all or because the cargo hold door or another door of an affected space is open and a sufficient fire extinguishing effect is not attainable due to the then possible air exchange with the ambient air in the case of a fire which actually exists.

In particular, the possibility of a triggering of the fire extinguishing system for a cargo hold in which, perhaps, persons may be present, also poses the requirement that, at present, the only extinguishing agents that may be used for cargo holds are those which are permissible for spaces occupied by persons. As was stated before, at present, the more favorable alternative extinguishing agents cannot be used for cargo holds.

SUMMARY

The goal of the invention is to present a fire extinguishing system for an airplane and a method for fighting fires in an airplane, which at least partially eliminate the disadvantages indicated herein.

The invention is produced from the features of the independent claims. Advantageous refinements and developments are the subject of the dependent claims. Other features, application possibilities, and advantages of the invention can be deduced from the following description, and from the explanation of an embodiment example of the invention, which is shown in the FIGURE.

The aspect of the goal concerning the fire extinguishing system is characterized by a fire extinguishing system for an airplane, comprising at least one extinguishing agent storage unit with an activatable closing device, which makes possible, when active, an outflow of the extinguishing agent from the extinguishing agent storage unit, and a supply line, connected with the closing device and at least one outlet opening, by means of which the extinguishing agent is supplied from the extinguishing agent storage unit to the outlet opening, so as to eject it there for firefighting, in that a control unit, connected with the closing device and a manually actuatable input element, is present, by means of which the closing device can be activated, in that one or more sensory systems are present, by means of which the current state of an airplane can be determined, and the control unit is constructed and configured in such a way that the closing device is activated, as a function of the current airplane state as it exists at the time the input element is actuated.

In contrast to the prior fire extinguishing systems, the fire extinguishing system in accordance with the invention functions in such a manner that the closing device is not activated, in every case, by an actuation of the input element, for example, by pressing a key that is protected against unintended operation in order to release the fire extinguishing system, thus emptying the unit of the extinguishing agent via the supply line and the at least one outlet opening. The activation of the closing device when the input element is operated takes place, rather, as a function of the current airplane state, determined by one or more sensor systems, that is, an airplane state as it exists at the time that the input element is operated and is correspondingly detected by the sensor systems. The sensors of the sensory systems are preferably designed redundantly.

The term "airplane state" is broadly understood in this case. It can be defined by arbitrary parameters, variables, aspects, etc., that characterize a state of the airplane or a state of its systems. One aspect of an airplane state can, for example, indicate whether the airplane is on the ground or airborne, or whether certain systems are deployable or not. It is thereby assumed that the sensory system(s) are constructed and configured in such a way that they are able to record the parameters, variables, aspects, etc., as a whole, that define the term "airplane state" with respect to content, so that the current airplane state can be determined therefrom.

Preferably, the control unit has a storage medium by means of which one or more prespecified airplane states, stored therein, can be provided. On the basis of this, a particularly preferred refinement of the fire extinguishing system in accordance with the invention is characterized in that the control unit is constructed and configured in such a way that the determined current airplane state can be compared with the provided, prespecified airplane states, and the closing device is activated as a function of the current comparison result determined at the time the input element is activated. Thus, concrete airplane states can be prespecified, so that when they currently exist, the closing device is either activated or not when the input element is operated. Preferably, the control unit is constructed and configured in such a way that if the determined current airplane state is identical with one of the provided prespecified airplane states, the closing device will not be activated. This is advantageous because the number of airplane states when an activation of the closing device should be omitted with the actuation of the input element is normally considerably smaller than the number of airplane states in which the closing device should be activated by the control unit with input element actuation.

The fire extinguishing system in accordance with the invention is permanently installed in the airplane and can be used as a fire extinguishing system for engines, auxiliary power units (APU, etc.), landing gear shifts, bleed air conduits, etc. The fire extinguishing system in accordance with the invention is used with particular preference for cargo holds. A particularly preferred variant of the fire extinguishing system in accordance with the invention is characterized therefore in that the at least one outlet opening is located in a cargo hold of the airplane, which has a cargo hold door; in that the first of the prespecified airplane states is defined by the following conditions: the engines of the airplane are turned off, and the cargo hold door is opened, and the control unit is constructed and configured in such a way that in the event that the determined current airplane state is identical with the first prespecified airplane state, the closing device is not activated. This prevents an activation of the closing device by an activation of the input element with the state "Electrical Power ON" if the engines are turned off and the cargo hold door is open. An unintended triggering of the fire extinguishing system for the cargo hold is thus prevented. At the same time, a triggering of the fire extinguishing system after a correctly signaled fire alarm of the fire alarm system for the cargo hold is prevented, if as a result of the open cargo hold door, firefighting with the cargo hold fire extinguishing system is not effectively possible. Finally, in this case, a release of extinguishing agent into the cargo hold in cases where persons might be present in the cargo hold will be ruled out.

The reason the conditions for the prespecified airplane state in the preceding were selected is that when these conditions exist, there is no way of ruling out the presence of persons in the cargo hold. Of course, other conditions or additional conditions can be used to define the prespecified airplane state, for example, the additional condition can be introduced that the airplane is on the ground and not moving, that is, the airplane is on its landing gear or is jacked up on supports.

With this development of the fire extinguishing system in accordance with the invention general conditions are created that may permit the use of alternative extinguishing agents for cargo holds, which were addressed above, since with a corresponding selection of the prespecified flight states, in cases where persons could be present in the cargo hold, the closing device is not activated. Thus, for cargo holds which are equipped with a fire extinguishing system in accordance with the invention, the stricter requirements for a space occupied by persons should not be the basis, but rather less strict requirements only for spaces not occupied by persons.

A signaling device connected with the control unit is preferably present in the cockpit, with which, for example, it is possible to signal that the determined current airplane state is identical with the prespecified airplane states. Thus, in order to remain in the previously described embodiment example, the determined current airplane state would fulfill the following conditions: the engines of the airplane are not turned off, and the cargo hold door is open, for example, warning lights are illuminated, in order to indicate that with an actuation of the input element, so as to activate the cargo hold fire extinguishing system—that is, to release the extinguishing agent into the cargo hold—an activation of the closing device does not take place. In this case, the alarm light indicates that the fire extinguishing system is, so-to-speak, deactivated. The signaling device is preferably located in the cockpit in the immediate vicinity of the manually operable input element. It is also conceivable that the control unit comprises an additional bridging function, for example, a so-called "override" switch, by means of which a "deactivation" of the fire extinguishing system can be overridden if the prespecified airplane state exists. After actuating this override switch, the closing device would then be activated in any case.

Another advantageous refinement of the fire extinguishing system in accordance with the invention is characterized in that in the supply line, which has at least one outlet opening upstream, there is a valve which can be switched on by the control unit; the valve can be switched from an open to a closed state and vice-versa, and when closed, it prevents an extinguishing agent from being supplied from the extinguishing agent storage unit to the outlet opening; and the valve can be switched on by the control unit, as a function of the determined current airplane state.

This valve can actuate, for example, an additional safety feature to the effect that in any case, even with an automatic triggering of the closing device, it can always be guaranteed that the fire extinguishing agent is not released via the at least one outlet opening, under the specifiable airplane states.

In a particularly preferred manner, the fire extinguishing system in accordance with the invention is characterized in that the at least one outlet opening is located in a cargo hold of the airplane, which has a cargo hold door, and the control unit is constructed and configured in such a way that the valve is switched to the closed state if the determined current airplane state fulfills the following conditions: the engines of the airplane are turned off and the cargo door is opened. By means of the valve closed in this airplane state, it is reliably prevented, under the indicated conditions, that in the case of an automatic triggering of the closing device, the extinguishing agent is introduced into the cargo hold. This closing device can be another important element for the admission of the aforementioned alternative extinguishing agent for a deployment in fire extinguishing systems for cargo holds.

Another aspect of the invention concerns an airplane which comprises a fire extinguishing system, in accordance with the preceding statements.

The aspect of the goal concerning the method for fighting fires is attained by a method for fighting fires in an airplane, which has at least one extinguishing agent dispenser with an activatable closing device, which, when activated, makes possible an outflow of the extinguishing agent from the extinguishing agent storage unit, and which has a supply line, connected with the closing device and at least one outlet opening, by means of which the extinguishing agent can be supplied from the extinguishing agent storage unit to the outlet opening, so as to eject it there for fighting fires, which is characterized in that a control unit, connected with the closing device and a manually actuatable input element, is present, by means of which the closing device can be activated, in that one or more sensor systems are present, by means of which a current airplane state is determined, and in that the closing device is activated by the control unit, as a function of a current airplane state which exists at the time of an input element actuation.

Preferably, one or more prespecified airplane states are provided to the control unit. Also preferably, the determined current airplane state is compared with the provided prespecified airplane states in the control unit, and the closing device is activated as a function of the current comparison result, determined at the time the input element is actuated. Furthermore, the method in accordance with the invention is characterized in that the at least one outlet opening is located in a cargo hold of the airplane, which has a cargo hold door, in that a first prespecified airplane state is defined by the following conditions: the engines of the airplane are turned off, and the cargo hold door is opened, and if the determined current airplane state is identical with the first prespecified airplane state, the control unit will not activate the closing device.

Another embodiment of the method is characterized in that in the supply line, which has at least one outlet opening upstream, there is a valve which can be switched on by the control unit, which can be switched from an open to a closed state and vice-versa, and when closed, prevents an extinguishing agent supply from the extinguishing agent storage unit to the outlet opening, and the control unit switches the valve as a function of the determined current airplane state.

In a particularly preferred refinement of the method in accordance with the invention, the at least one outlet opening is located in a cargo hold of the airplane, which has a cargo hold door, and the valve is switched to the closed state if the determined current airplane state fulfills the following conditions: the engines of the airplane are turned off, and the cargo hold door is open.

The statements made in connection with the fire extinguishing system can be analogously transferred to the method in accordance with the invention.

In particular, the invention enables the closing device to be activated by the control means only if the current airplane state prevailing at the time of the operation/actuation of the input element is identical with one of the prespecified airplane states or disables activation by the control means only if the current airplane state prevailing at the time of the operation/actuation of the input element is identical with one of the prespecified airplane states.

By an appropriate selection/definition of the prespecified airplane states and the control logistics stored in the control system, the specialist has a large number of possible developments of the fire extinguishing system in accordance with the invention or the method in accordance with the invention.

Other advantages, features, and details can be deduced from the following description, in which an embodiment example is described in detail, with reference to the drawing. Described and/or graphically depicted features form, by themselves, or in arbitrary, reasonable combination, the subject of the invention, perhaps also, independent of the claims, and can, in particular, also be the subject of one or more separate applications. The same, similar, and/or functionally equivalent parts are provided with the same reference symbols.

BRIEF DESCRIPTION OF THE DRAWINGS

The figures show the following:

FIG. 1 shows a schematic representation of a fire extinguishing system in accordance with the invention.

DETAILED DESCRIPTION

FIG. 1 shows a schematic representation of a fire extinguishing system in accordance with the invention on the example of a cargo hold fire extinguishing system. A fire extinguishing system is shown for a cargo hold 7 of an airplane. The cargo hold 7 has a cargo hold door 8, which can be opened for the loading and unloading of the cargo hold on the ground, and which is closed during flight operation. The fire extinguishing system comprises an extinguishing agent dispenser 1 in which the extinguishing agent is stored. The extinguishing agent dispenser 1 is connected with a pipeline/supply line 4, via a closing device 2, by means of which the extinguishing agent can arrive at outlet nozzles 6, arranged in the cargo hold 7, when the closing device is opened 2, so as to eject it for firefighting via the outlet nozzles 6. Upstream from the outlet nozzles 6, there is a valve 5, with which an extinguishing agent supply to the outlet nozzles 6 can be interrupted or prevented. Between the closing device 2 and the valve 5, which can assume the state of open or closed, there are, in this case, other units 3 of the fire extinguishing system, such as filters, pressure-limiting elements, pressure sensors, etc.

Furthermore, a control unit 10, connected with the closing device 2 and a manually actuatable input element 18, is present, by means of which the closing device 2 can be activated. The closing device 2 is, in this case, designed as diaphragms, which can be activated once—that is, which are burst once—pyrotechnically by means of an electrical ignition impulse, which is produced by the control unit 10. After such an activation of the closing device 2, the extinguishing agent flows out of the extinguishing agent dispenser 1 into the pipeline 4, and, depending of the switching state of the valve 5, via the exit nozzles 6, into the cargo hold 7.

Moreover, in this case, three sensor systems 11, 12, 13 are present, by means of which a current airplane state is determined. The determination of the current airplane state is carried out continuously, as soon as the airplane power supply network is supplied with current, that is, in the state "Electrical Power ON". The first sensor system 11 comprises two sensors 9, with which one can detect whether the cargo hold door 8 is closed or open. The sensors 9 are designed redundantly and linked with one another via a logical AND gate 14. The second sensory system 12 with one or more sensors 15 is designed and configured in such a way that one can determine whether the engines of the airplane have been turned off, that is, are not in operation. The third sensor system 13 with one or more sensors 16 is designed and configured in such a way that it is possible to determine whether the airplane is immobile on the ground, that is, is not flying but rather is on its own landing gear or, for example, jacked up on the ground. The airplane state which can be determined with the sensor systems 11, 12, 13 is described in this embodiment example, therefore, with three parameters. Of course, for the description of the airplane state, an arbitrary number of parameters, measurement values, and information can, of course, be used or referred to and combined, the selection of which is produced by a task formulation for the specialist, to be solved concretely.

The control unit 10 comprises a storage medium 20, by means of which, in this case, a prespecified airplane state is stored and can be provided, which is defined as follows: the airplane is immobile on the ground; the engines of the airplane are turned off; and the cargo hold door 8 is opened.

The control unit 10 is constructed and configured in such a way that when the determined current airplane state is identical with the aforementioned, prespecified airplane state, the closing device 2 is not activated, if the input element 18, connected with the control unit 10, is actuated. Moreover, the valve 5 is switched to the closed state, if the determined current airplane state is identical with the aforementioned prespecified flying airplane state.

The input element 18 is a key switch, located in the cockpit 17 and protected against an unintended actuation, next to which an optical signaling means 19 is located, which, in this case, signals—that is, lights up, blinks, etc.—as soon as the determined current airplane state is identical with the prespecified airplane state.

The described embodiment example of the fire extinguishing system in accordance with the invention can ensure that when the aforementioned, prespecified airplane state exists, no extinguishing agent can be introduced into the cargo hold 7 of the airplane as a result of an operation/operating error with the input element or an automatic triggering of the closing device 2. Therefore, the extinguishing agent cannot, in any case, come into contact with persons who are present in the cargo hold 7, for example, during loading or unloading.

REFERENCE SYMBOL LIST

1 Extinguishing agent storage unit
2 Closing device
3 Devices for the fire extinguishing system, for example, filters, throughflow limiting elements, etc.
4 Supply line, pipeline
5 Valve with the settings "open" or "closed"
6 Outlet openings, exit nozzles
7 Cargo hold
8 Cargo hold door
9 Sensor
10 Control unit
11 Sensor system with which it is possible to determine whether the cargo hold door is locked and closed
12 Sensor system with which it is possible to determine whether the engines are turned off
13 Sensor system with which it is possible to determine whether the airplane is standing still on the ground
14 Logical AND gate
15 Sensor
16 Sensor
17 Cockpit
18 Manually operable input element, secure key switch
19 Signaling means
20 Storage medium

The invention claimed is:

1. A fire extinguishing system for an airplane, the system comprising:

at least one extinguishing agent storage unit with an activatable closing device, the at least one extinguishing agent storage unit storing an extinguishing agent, the closing device capable of being activated to provide an outflow of the extinguishing agent from the at least one extinguishing agent storage unit;

a supply line connected with the closing device and at least one outlet opening located in a cargo hold of the airplane, the supply line capable of conducting the extinguishing agent from the at least one extinguishing agent storage unit to the at least one outlet opening, so as to eject the extinguishing agent from the at least one opening for fighting fire in the cargo hold;

one or more sensor systems capable of determining a current airplane state based on one or more parameters that indicate whether engines of the airplane are turned off and a cargo hold door of the cargo hold is open; and a control unit connected with the closing device and a manually actuatable input element, the control unit capable of automatically controlling the closing device in connection with the outflow of the extinguishing agent from the at least one extinguishing agent storage as a function of the current airplane state in relation to prespecified airplane states, determined at a time of a manual actuation of the input element in connection with the activation of the closing device.

2. The fire extinguishing system in accordance with claim 1, wherein the control unit has a storage medium that stores therein the prespecified airplane states.

3. The fire extinguishing system in accordance with claim 1, wherein the control unit compares the current airplane state with the prespecified airplane states to determine current comparison results, and controls the closing device to activate as a function of the current comparison results, determined at the time of the manual actuation of the input element.

4. The fire extinguishing system according to claim 1, wherein the control unit controls the closing device not to activate when the current airplane state is identical with one of the prespecified airplane states.

5. The fire extinguishing system according to claim 1, wherein:

a first prespecified airplane state is defined by conditions that engines of the airplane are turned off, and a cargo hold door of the cargo hold is open; and the control unit controls the closing device not to activate when the current airplane state is identical with the first prespecified airplane state.

6. The fire extinguishing system in accordance with claim 1, wherein the system further comprises a signaling means connected with the control unit, the signaling means for signaling that the current airplane state is identical with one of the prespecified airplane states.

7. The fire extinguishing system in accordance with claim 1, wherein:

the supply line has a valve between the closing device and the at least one outlet opening, the valve capable of being switched by the control unit from an open to a closed state and vice-versa; and the control unit switches the valve to the closed state as a function of the current airplane state, the valve preventing supply of the extinguishing agent from the extinguishing agent storage unit to the at least one outlet opening.

8. The fire extinguishing system according to claim 7, wherein the control unit switches the valve to the closed state when the current airplane state fulfills conditions that engines of the airplane are turned off and the cargo door is open.

9. A method for fighting fire in an airplane, the method comprising:

providing at least one extinguishing agent storage unit with an activatable closing device, the extinguishing agent storage unit storing an extinguishing agent;

connecting the at least one extinguishing agent storage unit with at least one outlet opening using a supply line, the at least one opening located in a cargo hold of the airplane;

determining a current airplane state using one or more sensor systems of the airplane, the current airplane state based on one or more parameters that indicate whether engines of the airplane are turned off and a cargo hold door of the cargo hold is open; and automatically controlling the closing device, using a control unit, in connection with outflow of the extinguishing agent from the at least one extinguishing agent storage to the at least one outlet opening as a function of the current airplane state in relation to prespecified airplane states, determined at a time of manual actuation of a manually actuatable input element in connection with the closing device.

10. The method according to claim 9, wherein the method further comprises storing the prespecified airplane states in a storage medium of the control unit.

11. The method according to claim 9, wherein the method further comprises:

comparing the current airplane state with the prespecified airplane states to determine current comparison results; and controlling the closing device to activate as a function of the current comparison results, determined at the time of the manual actuation of the input element.

12. The method according to claim 9, wherein the method comprises:

defining a first prespecified airplane state by conditions that engines of the airplane are turned off, and a cargo hold door of the cargo hold is open; and controlling the closing device not to activate when current airplane state is identical with the first prespecified airplane state.

13. The method according to one of claim 9, wherein the method further comprises:

providing in the supply line a valve between the closing device and the at least one outlet opening, the valve capable of being switched by the control unit from an open to a closed state and vice-versa; and switching the valve to the closed state as a function of the current airplane state, the valve preventing supply of the extinguishing agent from the extinguishing agent storage unit to the at least one outlet opening.

14. The method according to claim 13, wherein the valve is switched to the closed state when the current airplane state fulfills conditions that engines of the airplane are turned off, and the cargo door is open.

15. An airplane comprising a fire extinguishing system, the fire extinguishing system comprising:

at least one extinguishing agent storage unit with an activatable closing device, the at least one extinguishing agent storage unit storing an extinguishing agent, the closing device capable of being activated to provide an outflow of the extinguishing agent from the at least one extinguishing agent storage unit;

a supply line connected with the closing device and at least one outlet opening located in a cargo hold of the airplane, the supply line capable of conducting the extinguishing agent from the at least one extinguishing agent storage unit to the at least one outlet opening, so as to eject the extinguishing agent from the at least one opening for fighting fire in the cargo hold;

one or more sensor systems capable of determining a current airplane state based on one or more parameters that indicate whether engines of the airplane are turned off and a cargo hold door of the cargo hold is open; and a control unit connected with the closing device and a manually actuatable input element, the control unit capable of automatically controlling the closing device in connection with the outflow of the extinguishing agent from the at least one extinguishing agent storage as a function of the current airplane state in relation to prespecified airplane states, determined at a time of a manual actuation of the input element in connection with the closing device.

16. The airplane in accordance with claim 15, wherein the control unit has a storage medium that stores therein the prespecified airplane states.

17. The airplane in accordance with claim 15, wherein the control unit compares the current airplane state with the prespecified airplane states to determine current comparison results, and controls the closing device to activate as a function of the current comparison results, determined at the time of the manual actuation of the input element.

18. The airplane according to claim 15, wherein:

a first prespecified airplane state is defined by conditions that engines of the airplane are turned off, and a cargo hold door of the cargo hold is open; and the control unit controls the closing device not to activate when the current airplane state is identical with the first prespecified airplane state.

19. The airplane in accordance with claim 15, wherein:

the supply line has a valve between the closing device and the at least one outlet opening, the valve capable of being switched by the control unit from an open to a closed state and vice-versa; and the control unit switches the valve to the closed state as a function of the current airplane state, the valve preventing supply of the extinguishing agent from the extinguishing agent storage unit to the at least one outlet opening.

20. The airplane according to claim 19, wherein the control unit switches the valve to the closed state when the current airplane state fulfills conditions that engines of the airplane are turned off and the cargo door is open.

* * * * *